United States Patent [19]

Maleski

[11] 4,169,597

[45] Oct. 2, 1979

[54] BROADHEAD ARROW HEAD

[76] Inventor: Richard C. Maleski, c/o Wasp Archery Products, P.O. Box 760, Bristol, Conn. 06010

[21] Appl. No.: 842,729

[22] Filed: Oct. 17, 1977

[51] Int. Cl.[2] ..... F41B 5/02

[52] U.S. Cl. ..... 273/106.5 B

[58] Field of Search ..... 273/106.5 B

[56] References Cited

U.S. PATENT DOCUMENTS

| | | | |
|---|---|---|---|
| 3,756,600 | 9/1973 | Maleski | 273/106.5 B |
| 3,915,455 | 10/1975 | Savora | 273/106.5 B |

*Primary Examiner*—Paul E. Shapiro

*Attorney, Agent, or Firm*—Hayes & Reinsmith

[57] ABSTRACT

A broadhead arrow head is disclosed with one or more replaceable cutting blades each radially and longitudinally secured in a longitudinal slot of the broadhead body. Each blade has a mounting opening with an inside edge and a stepped trailing edge, and the blade itself is longitudinally movable in its slot between a mounting position, wherein the inside edge of the opening is located below a locking ring extending about the body in a relaxed condition, and a lock position wherein the stepped trailing edge underlies the locking ring to stress the locking ring and effect a radially inwardly directed force on the blade for securing it in position on the body of the arrow head.

8 Claims, 4 Drawing Figures

BROADHEAD ARROW HEAD

FIELD OF THE INVENTION

This invention generally relates to arrow heads and specifically concerns broadhead arrow heads or "broadheads" having a unitary body and one or more circumferentially spaced replaceable blades with razor sharp edges.

BACKGROUND OF THE INVENTION

A broadhead is normally used for hunting game and features a razor sharp replaceable cutting blade. As fully explained in my U.S. Pat. No. 3,756,600 entitled "Arrow Tip Having Replaceable Cutting Blades" issued Sept. 4, 1973, the blades can be replaced whenever they become dull; the blades can be removed when the the arrow is in storage to prevent injury; and an arrow shaft having the broadhead mounted thereon with the cutting blades removed can be used for practice shooting without substantially damaging the target or dulling the broadhead blades.

OBJECTS OF THE INVENTION

A primary object of this invention is to provide a new and improved broadhead arrow head which is particularly suited to effect significantly improved locking of each cutting blade to eliminate vibration and flutter during flight.

Another object of this invention is to provide such a broadhead which is easier and quicker to mount and remove the replaceable blades in position on the arrow head body.

A further object of this invention is to provide a broadhead of the type described which is economical to make, reliable under demanding field conditions and uses a minimum number of parts.

Other objects will be in part obvious and in part pointed out in more detail hereinafter.

SUMMARY OF THE INVENTION

The above objects are achieved in a construction wherein an elongated arrow head body is provided having axially extending slots for receiving a corresponding number of cutting blades, and a circumferentially extending locking groove is formed about the body to intersect the slots. A distortable split locking ring is received in the locking groove and is rotated into position with its gap registering with one of the slots. A blade is then mounted in that slot and is longitudinally movable in its slot between a mounting position and a lock position. The blades each include a mounting opening having an inside edge and stepped trailing edge. When each blade is in mounting position, the inside edge of its mounting opening is located below the surface of the locking groove at its intersection with the blade slot. Once so located, the split locking ring is rotated to pass through the blade opening and into position with its gap located over an adjacent blade slot to permit the next blade to be located in mounting position. This procedure is repeated for the remaining blades and the ring is moved into an operative position midway between any two blades. Thereupon, the broadhead is securely attached to a leading end of an arrow shaft which action causes each blade to move forwardly into seating engagement against a shoulder adjacent a nose cap of the broadhead. During such attachment the leading end of the arrow shaft moves the blades in their respective slots from mounting position, forwardly into lock position, whereupon the trailing stepped edge within the opening of each blade stresses the locking ring outwardly to effect a radially inwardly directed force to positively secure the blades in their slots in the body of the arrow head.

A better understanding of the objects, advantages, features, properties and relations of the invention will be obtained from the following detailed description and accompany drawing which set forth an illustrative embodiment indicative of the way in which the principle of this invention is employed.

DESCRIPTION OF A PREFERRED EMBODIMENT

Figure 1:
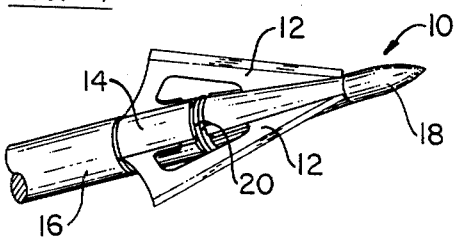
FIG. 1 is a perspective view of a broad head incorporating this invention.

Referring to the drawing in detail, FIGS. 1-4 show a broadhead 10 designed to receive three identical, replaceable cutting blades 12. It is to be understood that the design of the broadhead 10 may vary with regard to the number of blades 12 and that while the generally cylindrical body 14 of the broadhead 10 is preferably formed of aluminum, it may be formed of other suitable material. Likewise, arrow shaft 16 may also be formed of a variety of suitable materials such as aluminum, fiber glass, wood and the like.

Broadhead 10 includes the blades 12, the elongated body 14, a nose cap 18 and a pair of resilient, split locking or snap rings illustrated at 20. Body 14 is shown as having a maximum diameter adjacent its reduced threaded terminal end **14*a* to mate with a leading end of the arrow shaft 16. The diameter of body 14 tapers forwardly to merge with the projectile shaped nose cap 18 which may be press fit on a projecting front end 14*b*** of minimum diameter.

A plurality of longitudinally extending blade receiving slots 22 are formed in a symmetrical arrangement to extend axially of the body 14 to receive the replaceable blades 12. The slots 22 each extend from the maximum diameter rear portion of the body to the front end **14*b*. The rear end of nose cap 18 is illustrated as being counterbored to provide a skirt or shoulder 24 surrounding the projecting front end 14*b* of body 14**.

In the preferred embodiment, an annular locking groove 26 extends circumferentially about body 14 intermediate its ends and intersects each of the longitudinally extending slots 22. The snap rings 20 are received in the annular groove 26 to engage the body 14 along the bottom surface of the groove 26 when the rings are in a relaxed state. The depth of each slot 22 is shown as being significantly greater than the depth of the locking groove 26 at their intersections.

Figure 2:
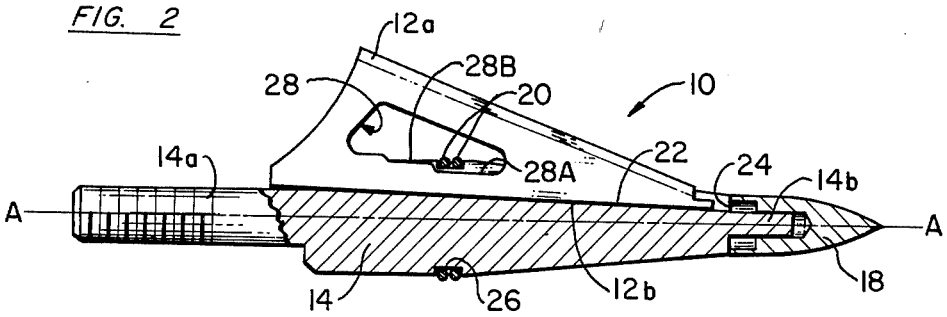
FIG. 2 is a side elevational view, partly broken away and partly in section, of the broadhead of FIG. 1 with a blade shown in mounting position.

The illustrated cutting blades 12 are of a general type described in my above referenced U.S. Pat. No. 3,756,600 and each have a cutting edge **12*a*** which, when the blade 12 is mounted in its longitudinal slot 22, is at an angle to the axis A—A of body 14 and is tapered toward nose cap 18. In accordance with this invention, a mounting opening 28 is provided in each blade 12 which in the specifically illustrated embodiment is shown as being an uninterrupted opening 28 formed in its entirety within the blade confines without access to any side of the cutting blade 12. Each blade opening 28 has an inside edge 28A extending generally parallel to body engaging base 12*b* of the cutting blade 12 which when assembled is parallel to axis A—A of body 14. The inside edge 28A of blade 12 is located below the surface of the locking groove 26 at its intersection with slot 22 when blade 12 is in mounting position (FIG. 2). Accordingly, the snap rings 20 may be each extended through the registering blade opening 28 quickly and easily after having initially aligned the open gap in each of the snap rings 20 with the longitudinally extending slot 22 prior to locating blade 12 in mounting position. Then the snap rings 20 may be rotated such that their respective gaps register with an adjacent blade receiving slot 22 and the next blade 12 is located within that slot 22 in mounting position prior to rotating the snap rings 20 again to align the snap ring gaps with the third and remaining blade receiving slot 22. Once the blades 12 are in mounting position on body 14, the snap rings 20 are rotated to locate their respective gaps midway between any pair of blades 12.

Thereupon, the broadhead 10 is rotated in its entirety to effect a threaded connection of end 14*a* with an internally threaded bore 30 on the leading end of arrow shaft 16 to releasably attach the broadhead 10 to arrow shaft 16. Such action causes the leading end of the arrow shaft 16 to engage the trailing end of each cutting blade 12 and to move it forwardly into lock position (FIG. 3) such that its reduced front blade tip is inserted within the space underlying shoulder 24 of nose cap 18 and in abutment against shoulder 24 to firmly lock each blade 12 longitudinally within their respective slots 22 with the rear ends of each cutting blade 12 being seated against the leading end of the arrow shaft 16.

Figure 3:
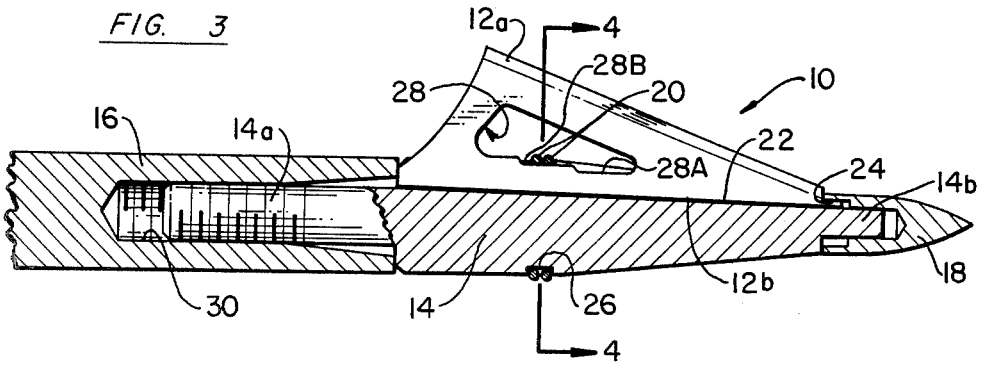
FIG. 3 is a side elevational view, similar to FIG. 2, partly broken away and partly in section, showing the blade in lock position and mounted on an arrow shaft.
Figure 4:
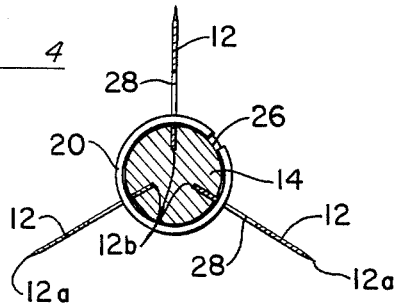
FIG. 4 is a cross section view taken generally along line 4—4 of FIG. 3.

The above described installation of the cutting blades 12 effects a cam action on snap rings 20 by virtue of a stepped trailing edge 28B which is in raised adjacent relation to inside edge 28A of each blade opening 28 thereby to stress the snap rings 20 to ride over the shoulder between edges 28A and 28B into lock position (FIG. 3). The resiliency of the snap ring material with the rings 20 in lock position accordingly effects a radially inwardly directed holding force onto each cutting blade 12 urging the blades against body 14 thereby to significantly reduce vibration and undesired flutter during use and to provide a more perfect and substantially noiseless flight.

It will be seen that upon reversing the above described installation steps, facile removal prior to replacement of any or all of the individually installed cutting blades is readily accomplished.

As will be apparent to persons skilled in the art, various modifications, adaptations and variations of the foregoing specific disclosure can be made without departing from the teachings of this invention.

I claim:

1. A broadhead arrow head comprising an elongated body, distortable locking means extending about the body, a blade extending longitudinally of the body and having a mounting opening formed within the body of the blade for receiving the distortable locking means, the blade having an inside edge and a stepped edge in trailing relation thereto, the inside edge and trailing stepped edge defining in part the blade mounting opening, the locking means upon its extension through the blade mounting opening being in non-interfering relaxed relation to the inside edge of the blade, the stepped trailing edge of the blade being dimensioned and configured relative to the body for engagement (said edge being engageable) with the locking means upon its being extended through the blade mounting opening, the locking means being stressed upon relative movement of the blade and locking means to effect engagement thereof with the stepped trailing (being engaged with said) edge of the blade (mounting opening) for effecting a radially inwardly directed force on the blade for securing it in position on the body of the arrow head.

2. The arrow head of claim 1 wherein the body has an axially extending slot, wherein the blade is longitudinally movable in the slot toward and away from a lock position, the locking means being stressed when the blade is in lock position to fix the blade longitudinally within the slot.

3. The arrow head of claim 2 wherein the blade is movable between a mounting position and said lock position, the blade in mounting position having its mounting opening registering with the locking means for readily extending the locking means in a relaxed condition through the mounting opening.

4. The arrow head of claim 1 wherein the body is generally cylindrical, and wherein the locking means comprises a split ring circumferentially extending about the body of the arrow head.

5. The arrow head of claim 4 wherein the split ring is interrupted by a gap therein registrable with the blade for extending the ring through its mounting opening upon rotating the ring relative to the blade and the body of the arrow head.

6. For releasable attachment to an arrow shaft, a broadhead arrow head comprising a generally cylindrical body having a pointed end and an opposite end releasably attachable to the arrow shaft, the body having an axially extending slot and a circumferentially extending locking groove intersecting the slot, the slot being of greater depth than the locking groove at their intersection, annular locking means in the locking groove, and a replaceable blade longitudinally movable in the slot between a mounting position and a lock position, the blade in lock position being positively fixed longitudinally within the slot when the body is secured to the arrow shaft, the blade including a mounting opening having an inside edge and a stepped trailing edge in raised adjacent relation to said inside edge, said inside edge being located below the surface of the locking groove at its intersection with the slot when the blade is in mounting position, and the stepped trailing edge being located above the surface of the locking groove at its intersection with the slot when the blade is in lock position.

7. A broadhead arrow head comprising an elongated body having an axially extending slot, distortable locking means extending about the body, a blade extending longitudinally of the body and being longitudinally movable within the slot between a mounting position and a lock position, the blade having a mounting opening formed within the body of the blade for receiving the distortable locking means, the mounting opening being formed in its entirety within the confines of the blade and having an inside edge and a stepped trailing edge in raised relation to said inside edge, the blade in mounting position having the inside edge of the mounting opening disposed below the locking means in a relaxed condition, the blade in lock position having the stepped trailing edge of the mounting opening in underlying relation to the locking means upon its being extended through the blade mounting opening to stress the locking means and effect a radially inwardly directed force on the blade to fix the blade within the slot in position on the body of the arrow head.

8. The arrow head of claim 7 wherein the body includes a circumferentially extending locking groove intersecting the slot in the body, the locking means comprising a split ring which in a relaxed condition engages the body defining the bottom of the locking groove, the stepped trailing edge of the mounting blade opening being in raised relation to the bottom of the locking groove when the blade is in lock position.

* * * * *

UNITED STATES PATENT AND TRADEMARK OFFICE

CERTIFICATE OF CORRECTION

PATENT NO. : 4,169,597

DATED : October 2, 1979

INVENTOR(S) : Richard C. Maleski

It is certified that error appears in the above-identified patent and that said Letters Patent is hereby corrected as shown below:

Column 4, line 9, delete "(said edge being engageable)";

Column 4, lines 13-14, delete "(being engaged with said)"; and

Column 4, lines 14-15, delete "(mounting opening)".

Signed and Sealed this

Twelfth Day of October, 1993

*Attest:*

Bruce Lehman

BRUCE LEHMAN

*Attesting Officer*

*Commissioner of Patents and Trademarks*